United States Patent [19]

Oka

[11] Patent Number: 4,835,569

[45] Date of Patent: May 30, 1989

[54] ELECTROPHOTOGRAPHIC COPYING MACHINE FOR PRODUCING POSITIVE PRINTS FROM BOTH POSITIVE AND NEGATIVE ORIGINALS

[75] Inventor: Tateki Oka, Toyohashi, Japan

[73] Assignee: Minolta Camera Kabushiki Kaisha, Osaka, Japan

[21] Appl. No.: 90,899

[22] Filed: Aug. 31, 1987

[30] Foreign Application Priority Data

Sep. 2, 1986 [JP] Japan ..... 61-206970
Sep. 2, 1986 [JP] Japan ..... 61-206971

[51] Int. Cl.[4] ..... G03G 15/00
[52] U.S. Cl. ..... 355/274; 355/268
[58] Field of Search ..... 355/3 DD, 3 DR, 3 TR, 355/14 TR, 3 CH, 14 CH, 3 R, 14 D

[56] References Cited

U.S. PATENT DOCUMENTS 3,877,803 4/1975 Seliger .
4,166,691 9/1979 Ebi et al. .
4,299,474 11/1981 Ernst et al. ..... 355/3 DR
4,500,195 2/1985 Hosono ..... 355/3 DR
4,627,703 12/1986 Suzuki et al. ..... 355/3 R

FOREIGN PATENT DOCUMENTS 60-176066 9/1985 Japan .

*Primary Examiner*—Arthur T. Grimley
*Assistant Examiner*—Ed Pipala
*Attorney, Agent, or Firm*—Burns, Doane, Swecker & Mathis

[57] ABSTRACT

The present invention relates to an electrophotographic copying machine which is capable of producing positive copies from both positive and negative originals. According to the invention, two units of developing apparatuses, each containing a toner with a polarity opposite to each other, are selectively mounted in position on the main body of the copying machine according to whether the copying is from positive to positive or from negative to positive so as to apply to the transfer charger a voltage with a polarity opposite to that of the toner.

5 Claims, 6 Drawing Sheets

ELECTROPHOTOGRAPHIC COPYING MACHINE FOR PRODUCING POSITIVE PRINTS FROM BOTH POSITIVE AND NEGATIVE ORIGINALS

BACKGROUND OF THE INVENTION

1. Field of the invention

The present invention relates generally to an electrophotographic copying machine and, more particularly, to one which has made it practicable to produce positive prints from both positive and negative originals.

2. Prior art

As a variety of electrophotographic copying machines in the copying method wherein a static latent image formed on the surface of a static latent image carrier is formed into a toner image by supplying an electrified toner thereto from a developing device and a sheet fed to a position between said static latent image carrier and a transfer device placed facing the image carrier is charged with a polarity differing from that of said toner by said transfer device so as for said toner image to be transferred onto said sheet, there have conventionally been available copying machines which are capable of producing positive images from positive originals (hereinafter referred to as "P - P copying") as well as from negative originals (hereinafter referred to as "N - P copying"). For this purpose the copying function of these copying machines is based on either of the following methods.

One method, as disclosed in Japanese Patent Publication No. 176066/1985, includes the use of two developing units containing toners. Each toner contained in each developing unit has a tendency to be charged with a polarity different from that of the other when coming into contact with a carrier. The method also includes the use of two electrical transformer units for transfer charger for charging said sheet with a polarity different from that of the toner.

The other method, as disclosed in U.S. Pat. No. 3,877,803, includes the use of a static latent image carrier sensitive to both positive and negative polarities and the use of a transformer for an electrifying charger and a polarity alternating switch, the latter two devices for changing the voltage polarities applied to the electrifying charger according to whether the copying is from a positive or a negative original.

The former method, however, requires that the copying machine has at all time two developer units and two transformer units for transfer chargers as integral parts, and therefore, a larger space is required for these devices in the copying machine as opposed to the generalized pursuit of compactness and reduction in size. Moreover, the application of the two methods requires expensive high-voltage relays for switching the connection of the transfer charger with one of two electrical transformer units or for alternating the voltage polarities of the electrical transformer, and switches for controlling them. This causes the problem of making the mechanism complicated and more costly.

In the latter method, it was a problem that the static latent image carriers available for the purpose are limited in type, requiring selection from a small variety, and are high in cost as well.

Generally, the copying method practiced by general users is P - P copying, while N - P copying is practiced rarely and in a limited number of application fields.

SUMMARY OF THE INVENTION

In view of the above-mentioned problems, the present invention has a primary object to provide an electrophotographic copying machine capable of obtaining a positive copied image by selectively mounting one of developing units to the copying apparatus.

A second object of the present invention is to provide an electrophotographic copying machine at a low manufacturing cost by enabling such a machine to dispense with expensive high-voltage relays and switches as accessories.

To accomplish this and other objects, the present invention provides an electrophotographic copying machine which is designed to be mounted selectively with either of two picture image-forming units according to the copying method—whether for P - P copying or for N - P copying—each unit with a developing device containing a toner with a polarity opposite to each other, so that a charge polarized inversely to that of the toner is applied to the transfer charger.

To be more specific, the present invention provides an electrophotographic copying machine having a static latent image carrier, an image-exposing means to form a static latent image by exposing an image on the surface of said static latent image carrier, a developing means for development to form a toner image by supplying charged toner to said static latent image formed, and a transferring means for transferring said toner image.

Said developing means for development comprises a first image-forming unit containing a first toner and a second image-forming unit containing a second toner which is charged with a polarity opposite to that of said first toner, said first or second image-forming unit being selectively mountable in a predetermined position on a main body of the copying machine. At least one of said first and second image-forming units is equipped with a power supply control means for supplying to said transferring means a voltage with a polarity differing from that of the charged toner contained therein.

BRIEF DESCRIPTION OF THE DRAWINGS

These and other objects, and features of the present invention, will become apparent from the following description in conjunction with the preferred embodiment thereof with reference to the accompanying drawings, in which.

DETAILED DESCRIPTION OF THE INVENTION

Figure 1:
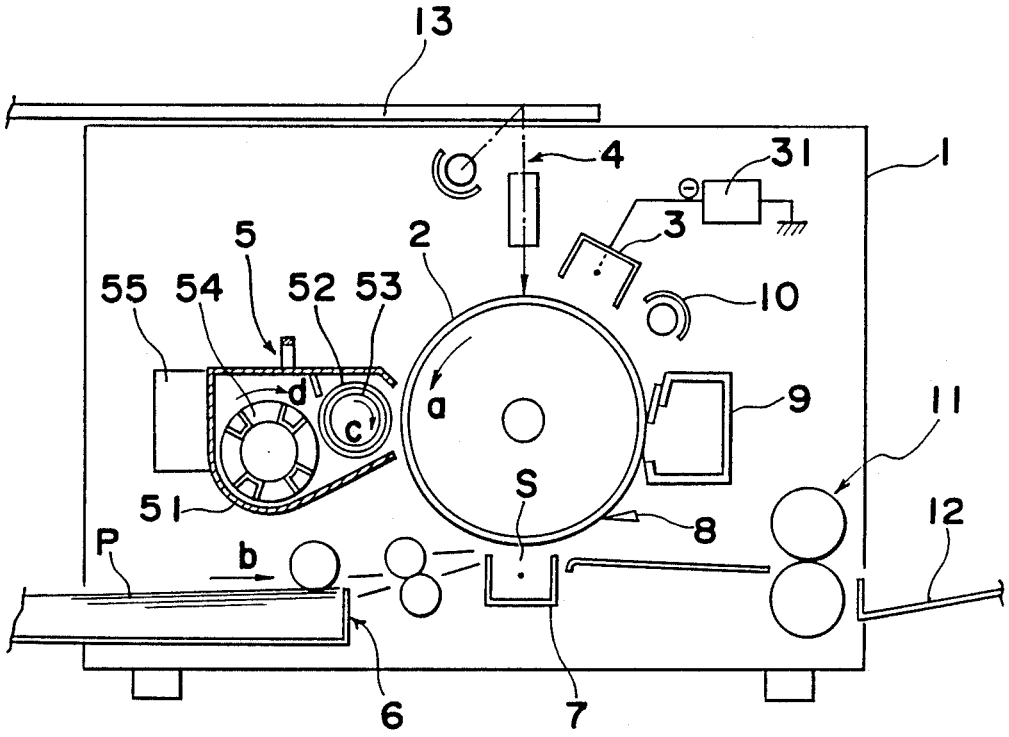
FIG. 1 is a schematic cross section of an electrophotographic copying machine according to a first embodiment of the present invention.

Before the description of the present invention proceeds, it is to be noted that like parts are designated by like reference numerals and symbols throughout the several views of the accompanying drawings.

Embodiment 1

Now are explained hereunder examples embodying the present invention with reference to drawings, beginning with a first embodiment and referring to FIGS. 1 through 5.

FIG. 1 shows a copying machine 1 which is equipped with a developing unit 5 as an image-forming unit embodying the present invention. Initially, the copying machine 1 is described with respect to its structural and mechanical outlines, and its operational details.

The surface of a photoreceptor drum 2, while rotating at a constant rate in the direction of the arrow a, is negatively charged (with −500V) by the discharge of a charger 3 which is negatively connected to a direct current power source 31.

Next, the original placed on a sheet glass 13 is irradiated with light transmitted by an optical system 4 so that the light reflected therefrom is exposed on the surface of the photoreceptor drum 2 to form a static latent image thereon and then a toner image corresponding to said static latent image by the successive action of the developing unit 5.

A copying sheet P is sent in the direction of the arrow b from a paper feeder 6, provided with said toner image, in the manner of transfer by a discharge of a transfer charger 7 at a transfer area S, and then removed from the surface of the photoreceptor drum 2 by a removing claw 8, and the sheet is brought to a fixation unit 11 for fixing the toner image and discharged at a paper discharge section 12.

The photoreceptor drum 2 continuously rotates in the direction of the arrow a in order for a cleaning device 9 to remove the residual toner therefrom and for an eraser lamp 10 to eliminate the residual charge.

There is now provided a detailed description of a developing unit 5.

Figure 2:
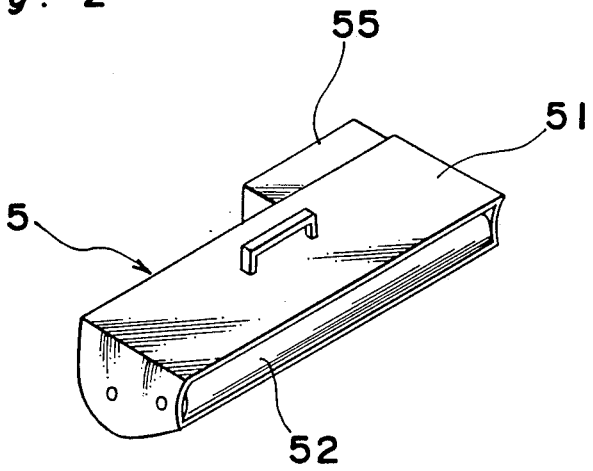
FIG. 2 is a perspective view showing a developing unit to be mounted on a copying machine shown in FIG. 1.

The developing unit 5 is an independent structure, as shown in FIG. 2, and is freely attachable and detachable to and from the copying machine 1 according to the need. The unit comprises a casing 51 in which a developing sleeve 52 with a magnetic roller 53 fixed therein and a bucket roller 54 are housed. These rotatable parts are connected to the respective drive mechanisms when the unit 5 is mounted in a predetermined position on the copying machine 1.

When a developing unit 5 is in working position on the copying machine 1, said bucket roller 54 starts rotating in the direction of the arrow d as a printing start switch (not shown in the drawings) is turned on, so that the two component type developing agents consisting of a mixture of toner and carrier and contained in said bucket roller 54 are stirred and mixed further in such a manner as to cause the toner to be charged by friction with the carrier and to supply part of the toner to the surface of the developing sleeve 52. The developing agent supplied to the surface of said developing sleeve 52, which is in the state of a magnetic brush, is carried in the direction of the arrow (c) and, by brushing along the surface of the photoreceptor drum 2, develops a static latent image as described above to form a toner image.

As a means 5 for development, there are two types of developing units (see FIGS. 3 and 4), the first developing unit **5*a* for P - P copying and the second developing unit 5*b* for N - P copying, each unit equipped with an electrical transformer unit 55 and a connector 58*a* or 58*b* on the unit side and the first developing unit 5*a* containing the first developing agent ($De_1$) consisting of a positively chargeable toner and a carrier and the second developing unit 5*b* containing the second developing agent ($De_2$) consisting of a negatively chargeable toner and a carrier. In the case of P - P copying, the first developing unit 5*a* is mounted to the copying machine 1. While in the case of N - P copying, the second developing unit 5*b* is mounted instead of the first developing unit 5*a***.

The electrical transformer unit 55 comprises a transformer 56 and a rectifier 57, both housed therein, and is designed to transform an alternating voltage input in said transformer 56 into a high-tension voltage and then into a direct current by said rectifier 57. The connector **58*a* or 58*b* on the unit side of each of the developing units 5*a* and 5*b*** comprises nine terminals $A_1$ through $A_9$ or $B_1$ through $B_9$.

Figure 3:
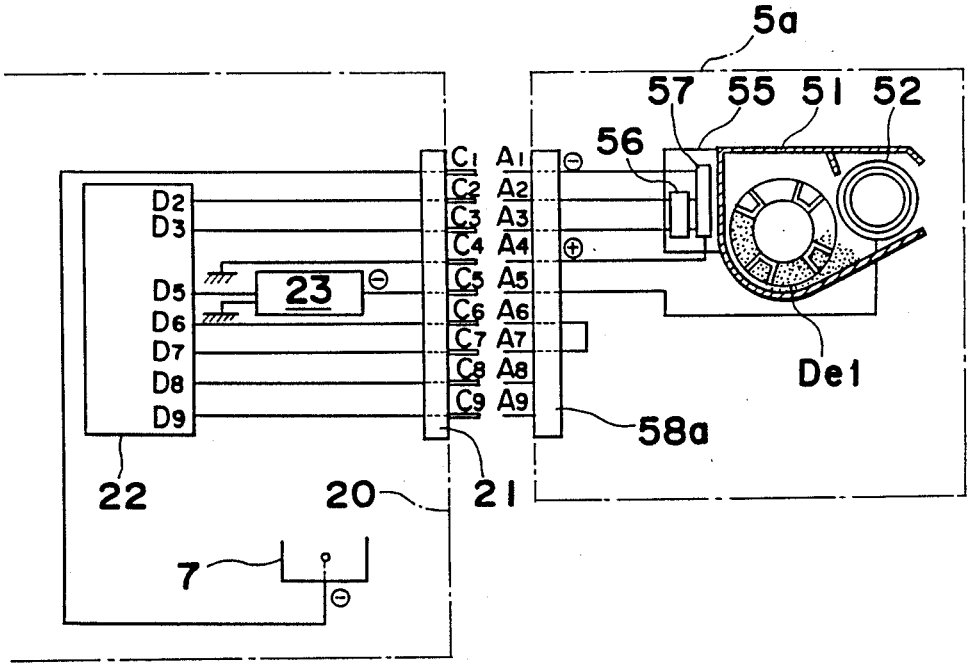
FIGS. 3 and 4 are each an electric circuit diagram showing the electrical connection of the developing unit (the first or the second) shown in FIG. 2 with the copying machine shown in FIG. 1.
Figure 4:
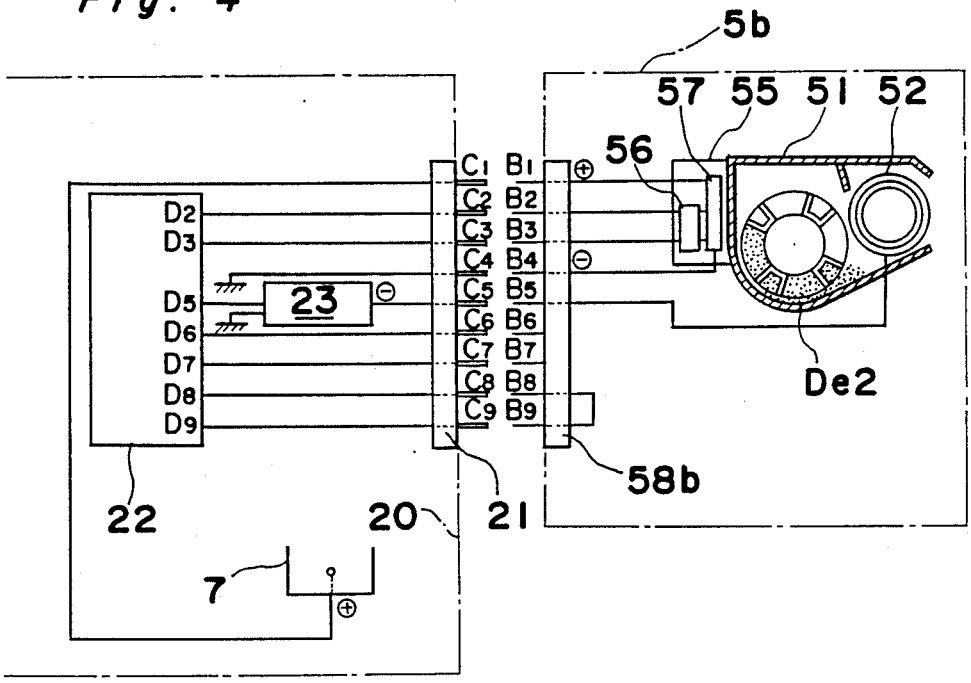

FIG. 3 shows the first developing unit **5*a* wherein terminal $A_1$ is connected to the negative terminal of the rectifier 57, terminals $A_2$ and $A_3$ to the transformer 56, $A_4$ to the positive terminal of the rectifier 57, A5 to the developing sleeve 52, $A_6$ and $A_7$ mutually connected, and A8 and $A_9$ left unconnected, whereas in the second developing unit 5*b*, as shown in FIG. 4, B1 is connected to the positive terminal of the rectifier 57, $B_2$ and $B_3$ to the transformer 56, B4 to the negative terminal of the rectifier 57, B5 to the developing sleeve 52**, $B_6$ and $B_7$ left unconnected, and $B_8$ and $B_9$ mutually connected.

The main body 20 of the copying machine, on which one of said first and second developing units **5*a*, 5*b* is mounted, has a connector 21** therefor.

The connector 21 in the main body 20 also comprises nine terminals $C_1$ through $C_9$, terminal $C_1$ being connected to a corona wiring for the transfer charger 7, $C_2$ and $C_3$ being source terminals $D_2$ and $D_3$ for the controls 22, $C_4$ to grounding, $C_5$ to the negative terminal of a developing bias power source 23, and $C_6$, $C_7$, $C_8$ and $C_9$ to the terminals $D_6$, $D_7$, $D_8$ and $D_9$ respectively of the controls 22. The terminal D5 of the controls 22 is connected to the developing bias power source 23.

With this structure, the terminals $A_1$ through A9 of the connector **58*a* on the side of the developing unit are connected to the terminals $C_1$ through $C_9$ of the connector 21 on the side of the main body when the first developing unit 5*a* is mounted on the main body 20 of the copying machine. The power source terminals $D_2$ and $D_3$ of the controls 22 are connected to the transformer 56, with the result that the rectifier 57 is supplied with a high-tension voltage and the negative charge of the direct current voltage produced by said rectifier is applied through the terminals $A_1$ and $C_1$ to the transfer charger 7. The positive terminal of said rectifier 57 is grounded through the terminals $A_4$ and $C_4$ The terminals $D_6$ and $D_7$ of the controls 22 form a closed circuit through the terminals $C_6$, $A_6$, $A_7$ and $C_7$ so that it can be detected that the first developing unit 5*a* has been mounted on the main body 20 of the copying machine, and thereby a signal corresponding to the detection is input to the developing bias power source 23 through the terminal $D_5$. Responding to the input signal, said developing bias power source 23 provides a voltage for the first developing unit 5***a*, a potential of −150 V to the developing sleeve 52 through the terminals $C_5$ and $A_5$.

Figure 5:
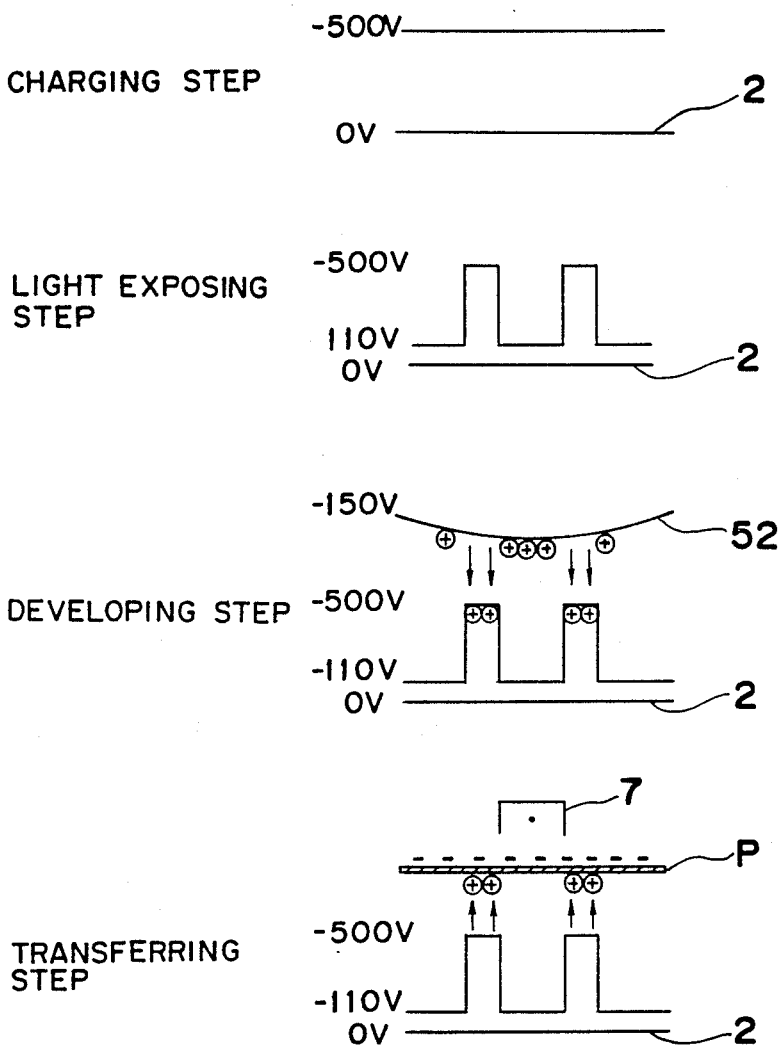
FIGS. 5 and 6 are, respectively, explanatory views showing an image-forming process of an electrophotographic copying machine as embodiment 1 of the present invention.

With the first developing unit 5*a* thus mounted on the main body 20, the copying machine is ready to perform P - P copying, the image-forming process being explained next with reference to FIG. 5.

First the surface of the photoreceptor drum 2 is charged with −500 V by a corona discharge by means of the charger 3 and the light from the optical system with which a positive original is irradiated is then exposed at the surface of the photoreceptor drum 2 so as to form a positive static latent image thereupon and the potential of the non-image area is thereby lowered to −110 V.

Next, a positively polarized toner is supplied from the first developing unit 5*a* and attached to the latent image (a process referred to as regular development). Since the surface of the developing sleeve 52 has a lower potential (−150 V) than the non-image area (−110 V), the positively polarized toner does not attach to the non-image area.

Next, at the transfer area (S), said positively charged toner is transferred statically from said image area to a sheet (P) as the sheet is charged with a negative polarity by a negative discharge of the transfer charger 7.

P - P copying, producing a positive image from a positive original, is thus performed.

When the second developing unit 5*b* is mounted in position on the main body 20 of the copying machine, the connector 58*b* on the developing unit is connected to the connector 21 on the main body, the terminals $B_1$ through $B_9$ respectively to $C_1$ through $C_9$, as shown in FIG. 4. The power source terminals $D_2$ and $D_3$ of the controls 22 are connected to the transformer 56, with the result that the rectifier 57 is supplied with a high-tension voltage and the positive charge of the direct current voltage produced by said rectifier is applied through the terminals $B_1$ and $C_1$ to the transfer charger 7. The negative terminal of said rectifier 57 is grounded through the terminals $B_4$ and $C_4$ The terminals $D_8$ and $D_9$ of the controls 22 form a closed circuit through the terminals $C_8$, $B_8$, $B_9$ and $C_9$ so that it is detected that the second developing unit 5*b* has been mounted on the copying machine 1, thus positioned for N - P copying. The controls 22 output a signal corresponding to the detection and transmit it to the development bias power source 23 through the terminal $D_5$ Thereupon the development bias power source 23 provides a voltage for N - P copying, a potential of −450 V to the surface of the developing sleeve 52 through the terminals $C_5$ and $B_5$.

Figure 6:
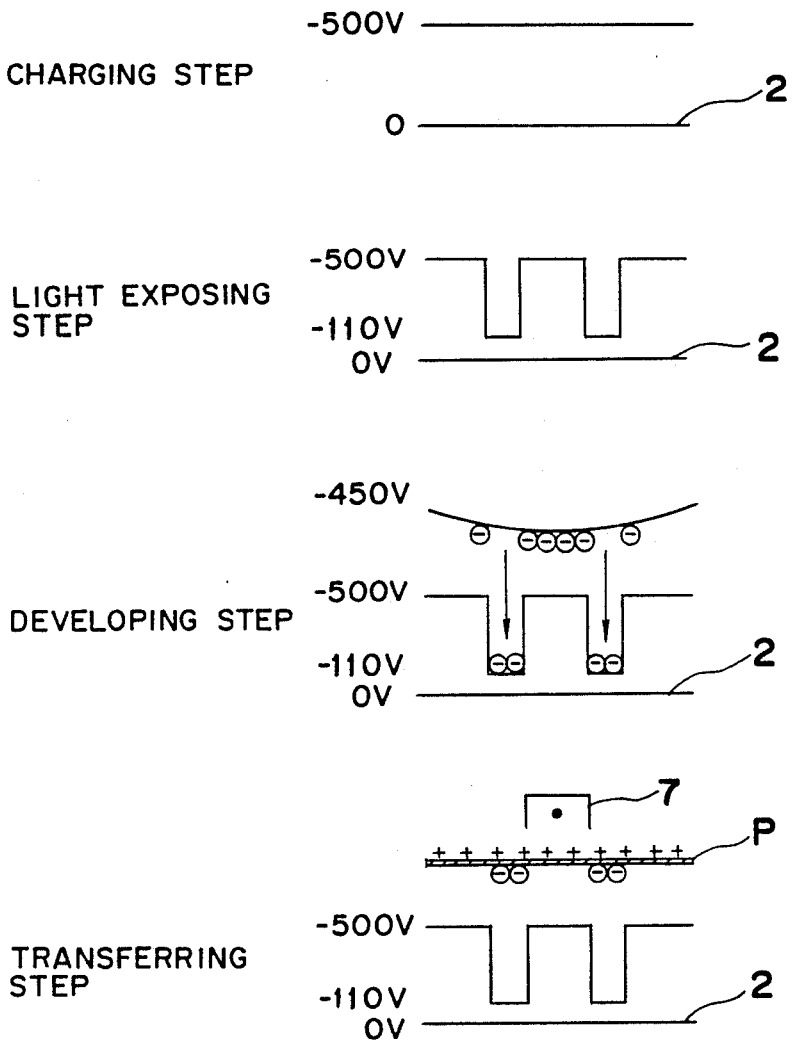

With the second developing unit 5*b* thus mounted the copying machine 1 is ready to perform N - P copying, the image-forming process explained next with reference to FIG. 6.

First the surface of the photoreceptor drum 2 is charged with −500 V by means of the charger 3 and the light from the optical system with which a negative image is irradiated is exposed at the surface of the photoreceptor drum 2 so as to form a negative static latent image. The potential of the image is then lowered to −110 V, whereas the potential of the non-image area remains charged at −500 V.

Next, a negatively polarized toner is provided by the second developing unit 5*b* and attaches to the latent image (by a process referred to as reversal development). Since the potential (−500 V) of the non-image area is lower than that (−450 V) of the developing sleeve 52, the negative toner does not attach to the non-image area.

Next, the negatively charged toner attaching to the image area is transferred onto a sheet which has been charged with a positive polarity by a positive discharge of the transfer charger 7.

N - P copying, producing a picture image from a negative original, is thus performed.

As is clear from the foregoing, a copying machine can be used for either P - P copying or N - P copying according to whether the first developing unit 5*a* or the second developing unit 5*b*, respectively, is mounted thereon. Accordingly, a user, whose use of a copying machine is only for P - P copying, requires only the first developing unit 5*a*. When the user needs one for P - P copying, the copying machine serves his purpose if he possesses a model of the second developing unit 5*b*.

Although only the developing unit 5 was described as attachable and detachable to and from the copying machine 1 in the foregoing description, change over between P - P and N - P copying can be practiced by replacement of a process unit consisting of a photoreceptor drum 2 and the first developing unit 5*a* mounted thereon with another like process unit using the second developing unit 5*b*. Also, as shown in U.S. Pat. No. 3,985,436, the photoreceptor, developing device and cleaning device can be considered as one unseparably unit regarding part replacement between P - P and N - P copying.

Embodiment 2

Figure 7:
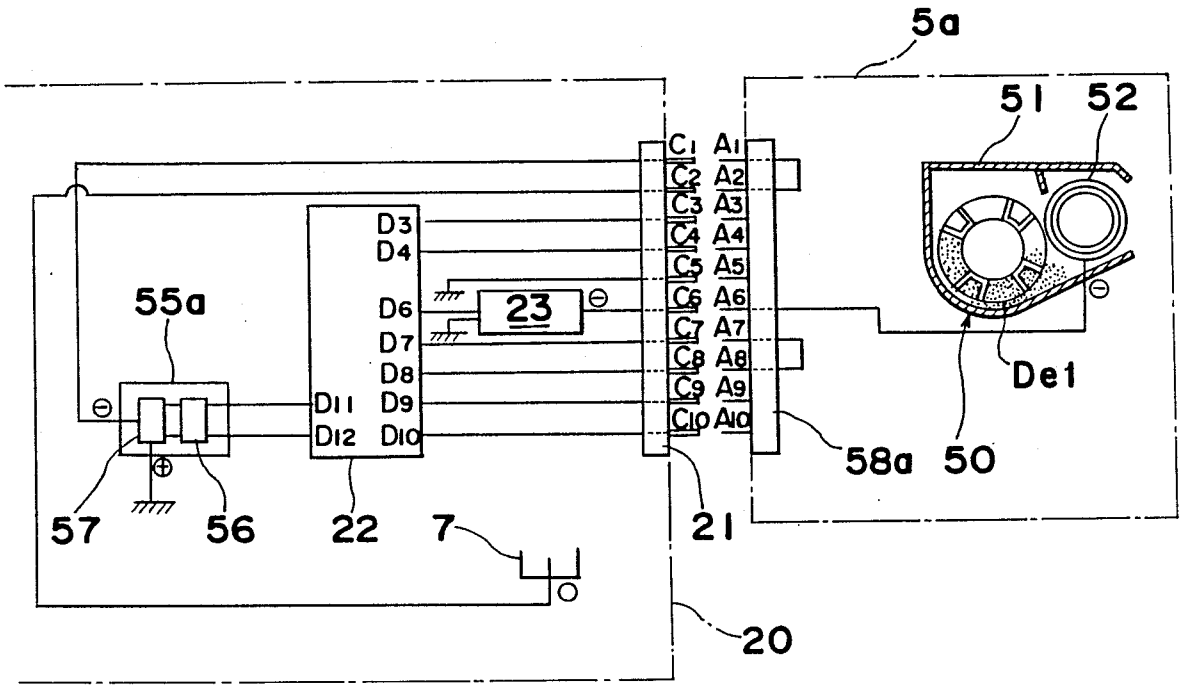
FIGS. 7 and 8 are each an electric circuit diagram showing, in a similar manner as FIGS. 3 and 4, the electrical connection of the development unit (the first or the second) with the copying machine according to a second embodiment of the present invention.
Figure 8:
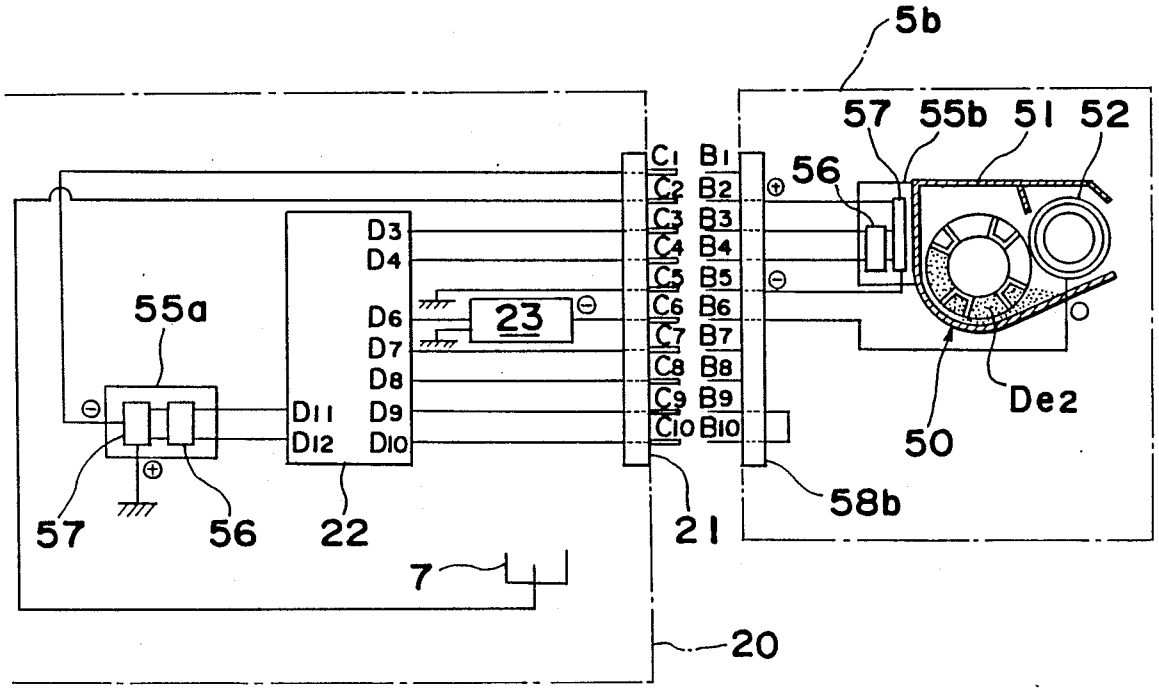

Referring now to FIGS. 7 and 8, there is explained hereunder a second embodiment 2 as another example of the present invention.

The copying machine employing for the second embodiment is the same as one shown in FIG. 1 except that the machine is provided with a transformer 55*a* (FIG. 7) as detailed hereinbelow.

In this embodiment, there are two types of developing units 5, the first developing unit 5*a* (see FIG. 7) which does not have a transformer unit for the transfer charger and is used for P - P copying and the second developing unit 5*b* (see FIG. 8) which does have a transformer unit for the transfer charger and is used for N - P copying. It is to be noted that the first and second developing units 5*a* and 5*b* of the second embodiment are almost the same as those of the first embodiment. Therefore, like parts are designated by like reference numerals. The first developing unit 5*a* contains therein the first developing agent ($De_1$) which consists of a positively chargeable toner and a carrier and the second developing unit 5*b* contains therein the second developing agent ($De_2$) which consists of a negatively chargeable toner and a carrier.

As shown in FIG. 7, the first developing unit 5*a* comprises a main body 50 and a connector 58*a* on the side of the unit including ten terminals $A_1$ through $A_{10}$, $A_1$ being mutually connected to $A_2$, $A_7$ mutually connected to $A_8$, each of $A_3$ through $A_5$, $A_9$ and $A_{10}$ left unconnected, and $A_6$ connected to a developing sleeve 52.

As shown in FIG. 8, the second developing unit 5*b* comprises a main body 50, a transformer unit 55*b* and a connector 58*b* on the side of unit. Said transformer unit 55*b* (the first transformer unit) is provided with a transformer 56 and a rectifier 57 inside. An alternating current voltage input into the transformer 56 is transformed into a high-tension voltage and into a direct current by the rectifier 57.

The connector 58*b* on the side of the unit in the second developing unit 5*b* comprises ten terminals $B_1$ through $B_{10}$, $B_1$, $B_7$, $B_8$ being left unconnected, $B_2$ connected to the positive terminal of the rectifier 57, $B_3$ and $B_4$ with the second transformer 56, $B_5$ to the negative terminal of the rectifier 57, $B_6$ to the developing sleeve 52, and $B_9$ mutually connected with $B_{10}$.

The main body 20 of the copying machine, on which the first or the second developing unit 5*a*, 5*b* is mounted, comprises a connector 21 on the side of the main body, the second transformer unit 55*a*, controls 22, and developing bias power source 23, with said second transformer unit 55*a* including a transformer 56 and a rectifier 57 as in said first transformer unit 55*b*.

Said connector 21 on the side of the main body has ten terminals $C_1$ through $C_{10}$, $C_1$ being connected to the negative terminal of the rectifier 57 in the second transformer unit 55*a* and the terminal $C_2$ being connected to the corona wiring of the transfer charger 7. The terminals $C_3$ and $C_4$ are connected to the power source terminals $D_3$ and $D_4$ of the controls 22, the terminals $C_7$ through $C_{10}$ are connected to the terminals $D_7$ through $D_{10}$ of the controls 22, the terminal $C_5$ is grounded, and the terminal $C_6$ is connected to the negative terminals of a developing bias power source 23.

The primary terminals of the transformer 56 in the second transformer unit 55*a* are connected to the terminals $D_{11}$ and $D_{12}$ of the controls 22, and the secondary terminals are connected to the rectifier 57, whose positive terminal is grounded.

The terminal $D_6$ of the controls 22 is connected to the developing bias power source 23.

With structural features as above, when the first developing unit 5*a* is mounted on the main body 20 of the copying machine, the terminals $A_1$ through $A_{10}$ of the connector 58*a* on the side of the developing unit are connected, as seen from FIG. 7, to the terminals $C_1$ through $C_{10}$ of the connector 21 on the side of the main body, respectively.

As a result, the negative terminal of the rectifier 57 is connected to the corona wiring of the transfer charger 7 through the terminals $C_1$, $A_1$, $A_2$ and $C_2$, and the negative terminal of the developing bias power source 23 is connective to the developing sleeve 52 through the terminals $C_6$ and $A_6$.

The terminals $D_7$ and $D_8$ of the controls 22 are mutually connected through the terminals $C_7$, $A_7$, $A_8$ and $C_8$ so that it is detected that the first developing unit 5*a* has been mounted on the main body 20 of the copying machine for P - P copying. Responding to this detection, the controls 22 output a signal for the first developing unit to the developing bias power source 23, which thereupon applies a voltage of −150 V to the developing sleeve 52.

With the first developing unit 5*a* thus in position on the main body 20, the copying machine is ready to perform the P - P copying. The image-forming process is same as that in the first embodiment illustrated in FIG. 5.

When the second developing unit 5*b* is mounted on the main body 20, as seen from FIG. 8, the connector 58*b* on the side of the unit is connected to the connector 21 on the side of the main body, the terminals $B_1$ through $B_{10}$ connected to the terminals $C_1$ through $C_{10}$, respectively. The connections close the circuit between the second transformer unit 55*a* and the transfer charger 7. The power source terminals $D_3$ and $D_4$ of the controls 22 are connected to the transformer 56 in the first transformer unit 55*b* through the terminals $C_3$, $B_3$, $C_4$ and $B_4$, and the rectifier 57 receives a transformed high-tension voltage and the positive potential of the direct current voltage obtained therefrom is applied to the transfer charger 7 through the terminals $B_2$ and $C_2$. The negative terminal of the rectifier 57 is grounded through the terminals $B_5$ and $C_5$. The terminals $D_9$ and $D_{10}$ of the controls 22 are connected through the terminals $C_9$, $B_9$, $B_{10}$, and $C_{10}$, so that it is detected that the second developing unit 5*b* has been mounted on the copying machine 1 for N - P copying. Thereupon, the controls 22 output a signal corresponding to this detection through the terminal $D_6$ to the development bias power source 23, which then provides a voltage for N - P copying, a surface potential of −450 V to the developing sleeve 52 through the terminals $C_6$ and $B_6$.

Thus, the main body 20 of the copying machine when mounted with the second developing unit 5*b* performs N - P copying. The image-forming process is same as that shown in FIG. 6.

The embodiment above has been described as having the first transformer unit 55*b* in the second developing unit 5*b* for N - P development, but it is practical as well to set the first transformer unit in the first developing unit 5*a* for the same purpose.

Although the present invention has been fully described by way of example with reference to the accompanying drawings, it is to be noted, here, that various changes and modifications will be apparent to those skilled in the art. Therefore, unless otherwise such changes and modifications depart from the scope of the present invention, they should be construed as included therein.

What is claimed is:

1. An electrophotographic copying machine having a static latent image carrier, an image-exposing means to form a static latent image by exposing an image on the surface of said static latent image carrier, a developing means for development to form a toner image by supplying charged toner to said static latent image formed, and a transferring means for transferring said toner image, wherein:

said developing means comprises a first image-forming unit containing a first toner and a second image-forming unit containing a second toner which is charged with a polarity opposite to that of said first toner, said first and second image-forming units being selectively mountable in predetermined position on a main body of the copying machine;

said first image-forming unit is provided with a first transformer for supplying to said transferring means a voltage with a polarity opposite to that of the charged toner contained therein and a connecting means for electrically connecting said transformer with the main body of the copying machine; and the main body is provided with a second transformer for supplying to said transferring means a voltage with a polarity opposite to that of the charged toner contained in the second image-forming unit.

2. An electrophotographic copying machine having a static image carrier, an image-exposing means to form a static latent image by exposing an image from a positive or negative original onto the surface of said static latent image carrier, a developing means for development to form a toner image by supplying a charged toner to a static latent image formed, and a transferring means for transferring said toner image, wherein:

said developing means comprises a first image-forming unit containing a first toner and a second image-forming unit containing a second toner which is charged with a polarity opposite to that of said first toner, a static latent image being formed by selectively mounting either said first or second image-forming unit in a predetermined position on the main body of the copying machine; and said first and second image-forming units include first and second transformers respectively, said first transformer supplying to said transferring means a voltage with a polarity opposite to that of the first toner and said second transformer supplying to said transferring means a voltage with a polarity opposite to that of the second toner.

3. An electrophotographic copying machine as claimed in claim 2, wherein, when a positive original is copied, the first image-forming unit is mounted on the body of the copying machine to carry out regular development and said first transformer applies to said transferring means a voltage with a polarity opposite to that of the first toner to form the positive image.

4. An electrophotographic copying machine as claimed in claim 2, wherein, when a negative original is copied, the second image-forming unit is mounted on the main body of the copying machine to carry out reversal development and said second transformer applies to said transferring means a voltage with a polarity opposite to that of the second toner to form the positive image.

5. An electrophotographic copying machine having a static latent image carrier, an image-exposing means to form a static latent image by exposing an image on the surface of said static latent image carrier, a developing means for development to form a toner image by supplying a charged toner to a static latent image formed, and a transferring means for transferring said toner image, wherein:

said developing means comprises a first image-forming unit containing a first toner and a second image-forming unit containing a second toner which is charged with a polarity opposite to that of said first toner;

said first and second image-forming units being selectively mountable in a predetermined position on a main body of the copying machine;

said first image-forming unit is provided with a first transformer which applies to said transferring means a voltage with a polarity opposite to that of the first toner;

the main body of the copying machine is provided with a second transformer which applies to said transferring means a voltage with a polarity opposite to that of the second toner; and when said first image-forming unit is mounted in position on the main body of the copying machine, said second transformer is held inoperative, whereas when said second image-forming unit is mounted in position on the main body of the copying machine, said second transformer is rendered operative.

* * * * *